US006939230B2

(12) United States Patent
Vancura

(10) Patent No.: US 6,939,230 B2
(45) Date of Patent: Sep. 6, 2005

(54) ENHANCED INTERACTION FOR CASINO GAMING RANDOM SEQUENCES

(75) Inventor: Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 252 days.

(21) Appl. No.: 10/225,822

(22) Filed: Aug. 21, 2002

(65) Prior Publication Data

US 2004/0038732 A1 Feb. 26, 2004

(51) Int. Cl.[7] ..... A63F 9/24
(52) U.S. Cl. ..... 463/25; 463/42
(58) Field of Search ..... 463/12, 13, 16–25, 463/26, 40–42, 1; 273/143 R

(56) References Cited

U.S. PATENT DOCUMENTS 4,240,635 A * 12/1980 Brown ..... 463/20
4,531,187 A * 7/1985 Uhland ..... 463/12
5,630,753 A * 5/1997 Fuchs ..... 463/9
5,695,402 A * 12/1997 Stupak ..... 463/20
5,758,875 A * 6/1998 Giacalone, Jr. ..... 273/143 R
5,851,148 A * 12/1998 Brune et al. ..... 463/25
6,024,642 A 2/2000 Stupak
6,077,163 A * 6/2000 Walker et al. ..... 463/26
6,093,102 A 7/2000 Bennett
6,113,495 A * 9/2000 Walker et al. ..... 463/42
6,139,431 A * 10/2000 Walker et al. ..... 463/20
6,254,481 B1 * 7/2001 Jaffe ..... 463/20
6,302,790 B1 * 10/2001 Brossard ..... 463/20
6,322,309 B1 11/2001 Thomas et al.
6,347,996 B1 * 2/2002 Gilmore et al. ..... 463/17
6,375,187 B1 * 4/2002 Baerlocher ..... 273/143 R
6,569,013 B1 * 5/2003 Taylor ..... 463/13
6,599,192 B1 * 7/2003 Baerlocher et al. ..... 463/25
6,663,487 B1 * 12/2003 Ladner ..... 463/13
6,695,695 B2 * 2/2004 Angel ..... 463/13
6,695,696 B1 * 2/2004 Kaminkow ..... 463/16
6,709,330 B1 * 3/2004 Klein et al. ..... 463/9
6,712,698 B2 * 3/2004 Paulsen et al. ..... 463/30
6,729,618 B1 * 5/2004 Koenig et al. ..... 273/138.2

FOREIGN PATENT DOCUMENTS

GB 2 087 618 A 5/1982
GB 2185612 A 7/1987

* cited by examiner

*Primary Examiner*—Michael O'Neill
(74) *Attorney, Agent, or Firm*—Dorr, Carson, Sloan, Birney & Kramer, P.C.

(57) ABSTRACT

Methods for enhanced interactive playing of a casino game on account of an attribute by a player have steps including. The steps of establishing one or more threshold criteria for tracking the attribute and allowing the player to wager and play the casino game are performed. The actual casino game data related to the attribute is tracked. The player is provided with enhanced interaction if the tracked data fulfills at least one threshold criteria during enhanced interactive playing of the casino game.

26 Claims, 4 Drawing Sheets

ENHANCED INTERACTION FOR CASINO GAMING RANDOM SEQUENCES

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention relates to particular improvements in the methods and apparatus for playing a game with inclusion of enhanced interaction for preset sequences of random game outcomes.

2. Description of Related Art Including Information Disclosed Under 37 CFR 1.97 and 1.98

In the United States legal and regulatory requirements provide that "the selection process to determine a casino game outcome must be random." Randomness implies independent event outcomes that are distinct. In principle, in a random process, any particular outcome is unrelated to past or future outcomes. Nevertheless, insofar as preset sequences of random outcomes are, in themselves, also chance, this disclosure attempts to offer methods of enhanced interactivity on the part of the apparatus, either in the form of messages or payoffs for attributes of or pertaining to such sequences.

U.S. Pat. No. 6,093,102 discloses the multi-line pay lines in a slot machine displaying a plurality of symbols in a matrix of n rows and m columns of symbol positions. A game control has images displayed and pays if a predetermined combination of symbols is displayed. A predetermined arrangement of symbol positions includes one and only one symbol position in each column of the array. The display has symbols in 3 rows and 3, 4 or 5 columns.

U.S. Pat. No. 6,322,309 discloses a typical slot machine for bonusing with touch screen selectable elements. It is with the '102 patent incorporated herein by reference and made a part hereof as at least that which skilled artisans would have known regarding how a slot machine is made and operates.

U.S. Pat. No. 6,024,642 has a game of chance in which a sequence consisting of a preset number of losses is used to yield a jackpot to the player. Unfortunately, '642 has changing the odds of winning or losing within the sequence. That approach would appear to violate the regulatory and/or legal requirements of jurisdictions in the United States. In an attempt to overcome that, '642 suggests that the player be required to wager on an entire sequence of games in advance, treating the entire sequence of games as "an event" to thereby accommodate the regulations. In practice that approach would be difficult to successfully market and/or commercialize as players seem to prefer maximum flexibility in their wagering. Under the approach of '642, a player would have to commit funds toward, e.g., 10 games worth of wagering before playing any of the games. As this is a major commitment, and could stand to result in considerable losses for the player, it is not preferred and thus problematic for players. Observation also indicates that many players prefer to modify their wagering on a game-by-game basis based on the results of previous game or few games.

Gaming machines in the United States have become increasingly complex. Players are demanding more interactivity with the casino games including slot machines with high interactivity such as those from Mikohn Gaming Corporation of Las Vegas, Nev. (e.g., Battleship, Ripley's Believe It or Not!). In those specific games, interaction has proved to be a very successful inclusion. There is a need to provide additional interactivity between a slot machine with a player.

Because, at its essence, gambling involves the wagering of money, followed by winning or losing money, it would be desirable to provide additional interactivity as a function of the player's short-term fortunes on a particular machine.

However, it is necessary for the casino games to conform to strict regulatory standards ensuring randomness in United States jurisdictions. This is unlike British "fruit machines" which proactively monitor coin-in and coin-out and adaptively modify odds, pay out, etc. to "force" the machine to a prescribed hold percentage. In GB 2,185,612A and GB 2,087,618A, for example, the adaptive logic approach is taught.

It is desirable for the player to maintain maximum flexibility in wagering. Enhanced interaction, as a part of the game without forcing the player to "pre-wager" on entire sequences of games so the player is able to wager as desired has not been disclosed.

Bonus games are now very popular. There is a need also to enhance interactivity within the bonus game. To date, bonus games are "canned" in the sense that a player entering a bonus round always experiences the same ordered series of events. This usually includes an introductory screen and/or music, rules of play, then play and a closing celebratory sequence, or variations thereof, etc. Indeed, many players now play slot machines primarily to get to the bonus games wherein, at no risk to the player, the bonus round necessarily provides the player with that winning monetary experience. Currently, players who quickly enter the same bonus round (e.g., within a few spins on the base game) may be disappointed and/or bored to see it, the exact "canned" routine presentation and play. The bonus game is more likely to become "stale" or predictable. There exists a need with players for variety to prevent the experience of the same bonus game having a plurality of occurrences within a short time. On the other hand, players who have not experienced a bonus round in quite some time (e.g., within a few hundred spins on the base game) may become disenchanted with the game as a whole. They are likely to stop playing after becoming frustrated. So a need exists to have incentive for players to continue to play a slot machine, who have not experienced a bonus in a fairly long time.

Other "parallel" bonuses (in which multiple spins are required to achieve the end result) monitor the player's wager and calculate the resulting award based on or relative to the total player's wager in the base game before entry to and for use in the bonus game. This has the deleterious effect of giving the player a small award. If successive bonus sequences occur in short order the bonus pay out would most likely be small.

In the Mikohn Gaming Corporation, of Las Vegas, assignee of this disclosure, slot machine "Battleship," if the player within the bonus game successfully sinks all the enemy ships, an additional bonus game is awarded in which the player is assured of winning an additional prize. In the Atronic game "Sphinx," if the player within the bonus game picks the correct sarcophagus, an additional bonus game is awarded in which the player is assured of winning an additional prize. In the IGT slot machine "Regis' Millions," the Philbin character in the bonus game occasionally awards the player an additional prize. It is believed that in each of these games, the awarding of an additional prize within the bonus game is merely a self-contained function of the bonus game and not interaction based on preset sequences of random game outcomes.

BRIEF SUMMARY OF THE INVENTION

The solution, as disclosed herein, provides enhanced interaction for preset sequences of random game outcomes. It includes using the general results of the games with odds for each trial (i.e., spin) remaining independent. The solution also maintains maximum player flexibility with regard to wagering, while at the same time providing enhanced interaction as a function of the player's outcome for previous spins. Overall, then, the solution as disclosed herein behaves in accord with strict gaming regulations in jurisdictions within the United States while affording the player a new and unique manner of slot machine interaction. Continued play of a slot machine ensues if the feature of enhanced interaction is in a game. The interaction keeps the game fresh for players who enter frequently or repeatedly the same bonus game, while encouraging players to continue who have not entered recently a bonus game.

Summarily, the instant invention provides enhanced interaction to the player for preset sequences of random game outcomes. In a preferred embodiment, the enhanced interaction takes the form of a "host" (e.g., an animated three-dimensional character is preferred) communicating with the player by gestures and sayings. In another preferred embodiment, the host not only interacts with the player on a sensory level, but also on a monetary level, providing the player with bonuses based on the outcomes of previous games of play. In a preferred embodiment, preset sequences are by the machine monitored for a preset attribute of interest. In a most preferred embodiment, the attribute of interest is historical and mathematical, e.g., the number of games between visits to a bonus round.

It is an advantage of the present invention that the game or a host thereupon, seemingly interacts with the player. This makes the player more inclined to play the instant invention versus a typical slot machine.

It is a further advantage of the present invention that the game or a host thereupon, has feelings of favor, admiration, respect, solace, etc. for the player. Thus, seemingly personalizing the play of the game for the player.

It is a further advantage of the present invention that the game or a host thereupon, monetarily rewards the player for past performance.

DETAILED DESCRIPTION OF THE INVENTION

Figure 1:
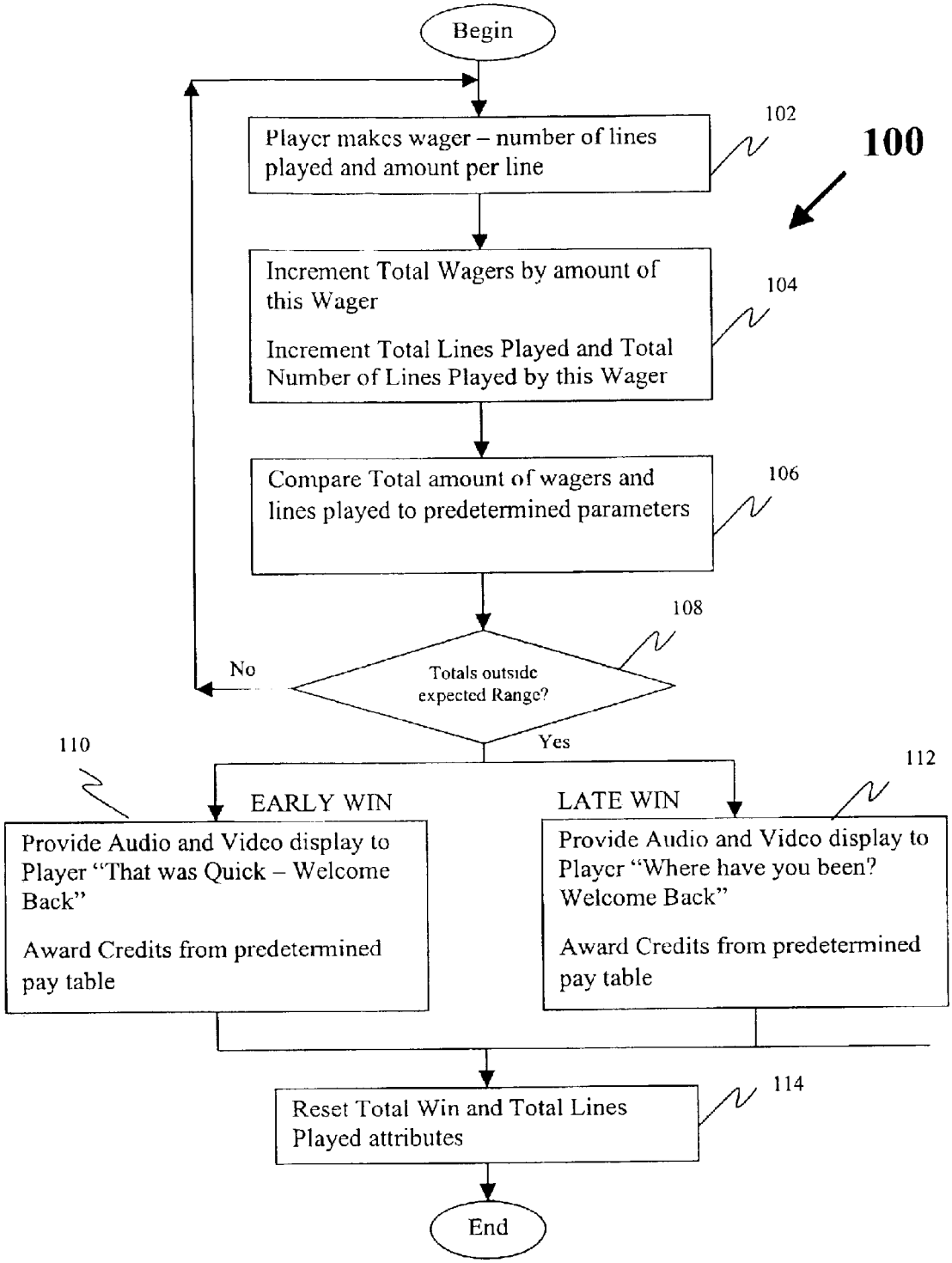
FIG. 1 is a block diagram of a flow chart with the steps of a preferred embodiment of the method for an enhanced interactive casino game.

To further describe the preferred mode of operation, consider a video slot machine as the preferred embodiment of the instant invention. The machine has traditional payoffs corresponding to symbol combinations. It also has one or more bonus games that are initiated either by combinations of unique trigger symbols, or other suitable ways. It allows wagering on multiple lines (e.g., 9). For purposes of the discussion below, we consider one bonus game which is mathematically designed to occur, on average, every 100 spins (but only for 9-lines wagered) by the player. For normal play, the bonus game features the host welcoming the player, explaining the rules, and otherwise interacting with the player during play of the bonus game.

As a first embodiment of the instant invention, the attribute of interest is the bonus game. There is provided additional interaction within the bonus game if, mathematically, the player achieves visits to the bonus game appreciably different from that expected via mathematical calculations.

For example, there is provided additional enhanced interaction within the bonus game if the player randomly achieves back-to-back entries (on successive spins) to the bonus round. Instead of experiencing a "canned" routine of introduction, rules, etc., the "host" of the bonus round instead immediately comments, e.g., "It's nice to see you again so soon!" In this way, the fact that the player has been able to visit the bonus round again fairly quickly is acknowledged to the player. This has the benefit of making the game more interactive to the player, who feels that the game is acknowledging the personal feat just accomplished. In principle, of course, the player need not receive this message only for back-to-back visits to the bonus round. For example, the game logic might be programmed to state this message if the number of spins is 50 or less (for a game designed, as noted earlier, to be an average of 100 games between bonus rounds).

On the other hand, if the player has gone a long time (say, 342 games between visits to the bonus round wherein, as noted earlier, it is designed to be an average of 100 games). Then the "host" of the bonus round may instead comment, "Glad you're back; what took you so long?" or "Thanks for your dedication!" Again, this has the benefit of acknowledging the specific player's poor fortune, hence likely to at least ameliorate any mild frustration resulting from the time taken to get back to the bonus round. In essence, the game is made more personal and thus appealing to the player because the enhanced interaction seeks to play to and/or adjust to the feelings of the player.

As a second preferred embodiment, the game also monetarily pays based on preset sequences of random game outcomes. So, in the first case above, the back-to-back player may be awarded an additional bonus within the bonus game, simply for being "lucky." E.g., "It's nice to see you again so soon! Here are 100 credits for your good fortune." This strongly affects the player, who not only is clearly acknowledged for getting back to the bonus round quickly, but is also monetarily rewarded for doing so! Preferably, back-to-back visits to the bonus round are worth the most monetarily (as they are the most rare), but any relatively recent visit (mathematically speaking) is given some award.

It also has the additional benefit of keeping the game new, in that multiple phrases and award amounts may be randomly is given to the player.

Alternately, a player that took a long time (in terms of spins, e.g.) to get back to a bonus may be awarded an additional bonus for his "patience." e.g., "Glad you're back. Here are 250 credits for your dedication!" This also strongly affects the player in a positive fashion, not only acknowledging the player's poor fortune in taking so long to get back to the bonus round, but also compensating the player for doing so. This has the additional benefit of encouraging players to continue to play the game, even if they have played a long time without reaching the bonus round. In other words, players familiar with the enhanced interactive game will understand and appreciate that, in principle, the longer they play without reaching the bonus round, the more money (or monetary equivalent, e.g. credits) they will ultimately be rewarded for their patience in finally reaching the bonus round.

In operation, it is necessary to monitor the player's past history for the feature under consideration. In the most preferred embodiment, the enhanced interaction is provided to the player for a particular bonus game feature. In the preceding example, in which the player, for each pay line, has a 1 in 900 chance of aligning the appropriate trigger symbols and entering the bonus game (i.e., a 1 in 100 chance per spin if wagering on all 9 pay lines). Hence, the player's total wager and number of "pay line games" are in this example attributes to be monitored. The number of "pay line games" is requisite as it reflects the actual probability of entering the bonus game (since in this example, the bonus game is entered via a pay line combination of trigger symbols). The player's total wager is requisite as the player who wagers more is, in principle, due more in terms of awards, by an amount roughly proportional to the wagering level.

Those two attributes are reset after the player finishes the bonus game under consideration, and are thereafter monitored while the player is playing the base game until again visiting the bonus game under consideration. Consider the case in which the player wagers 2 credits on each of 5 lines, and after 10 spins again enters the bonus game. The current monitored data would then reflect 50 "pay line games" and 100 credits wagered between bonus visits. On the other hand, if the player took 400 spins at 5 credits on each of 9 lines to again visit the bonus game, the current monitored data would reflect 3,600 "pay line games" and 18,000 credits wagered.

From the aforementioned game parameters, it should be clear that the average monitored data between bonus visits is 900 "pay line games" or alternately, 900 wagers. Hence, the player who entered with only 50 wagers would be eligible for a statement such as "That was quick! Nice to see you here so soon!" On the other hand, the player who had 3,600 eligible wagers between bonus visits has, in fact, taken four times the expected length of time between bonus games and would be eligible for a statement such as "Wow, I thought I'd never see you again! Your determination has finally paid off!" Similarly, each of these players would be eligible for an additional monetary award in a preferred embodiment. But the instant gratification from the interaction of the vocalizing game is designed to be uplifting and so the same. Thus, it is hoped that play will continue notwithstanding the difference in time between the quick and slow wins of bonus game entry.

The instant invention is not limited to enhanced interaction based upon the number of wagers between bonus games. Indeed, it may be used in a manner described before to provide enhanced interaction if the player has not made it to a bonus game within a prescribed number of wagers. In the example explained, the average number of wagers between bonus games is 900. The invention may be used in a slightly different manner in order to encourage the player to keep trying while waiting for the bonus to occur. In this case, one or more threshold levels may be preset, with actual play monitored to see if a threshold level is fulfilled. For example, the following threshold may be in effect for a game in which, on average, 900 wagers are needed between visits to a bonus round:

1,000 "Keep trying!"
1,500 "It's been a long time, but don't give up!"
2,000 "Phew, let's get back to the bonus! Here's X credits for your trouble!"

So, if the player goes, e.g., 1500 wagers without again entering the bonus round, the host may appear on the base game and state, "It's been a long time, but don't give up!" If the player goes another 500 wagers (to a total of 2,000 without visiting the bonus round), the host may state, "Phew, let's get back to the bonus! Here's X credits for your trouble!" Here, "X" is an amount that is calculated in real time. As described earlier, the actual award "X" would be a function not only of the 2,000 wagers but also the cumulative amount of each of these wagers (or similarly, the average of these wagers).

Too, the instant invention, as applies to bonus games and may be used simultaneously with multiple bonus games. In this case, each bonus game may be considered a separate attribute. Alternately, the attribute of interest may be "any bonus game" in which case the information tracked is the number of wagers between any visit to any of the various bonus games.

In practice, the rules of qualification for the attribute are preferably factored into the logic of tracking the attribute. For example, consider a 3-coin max mechanical spinning-reel slot machine in which a bonus game is the attribute of interest. As just one example, if the player needs to wager 3 coins to be eligible for the bonus game, then wagers of 1 or 2 coins are preferably ignored in terms of tracking this attribute. However, wagers of 1 or 2 coins may be tracked for a different attribute of, for example, a base game pay of 7—7—7.

A method in FIG. 1 for providing enhanced interactive playing of a casino game by a player has steps and is shown. The player is allowed to make a plurality of wagers and ensuing plays 102. One or more attributes of a sequence of ensuing plays are monitored 104 and one or more attributes of the sequence achieved by the player are pointed out in steps 110 or 112. An award for the player interactively personalizes the playing of the game in steps 110 or 112. The step of pointing out is performed with audio in steps 110 or 112. The step of pointing out is visually delivered in steps 110 or 112. Additionally, if desired, a monetary pay may be given to the player in steps 110 or 112. The step of pointing out one or more attributes of the sequence includes mathematical interpretation 106 and wherein the step of monitoring of one or more attributes of the sequence includes analyzing how the one or more attributes of the sequence differs appreciably from that expected from that expected via predetermined parameters 108. Upon completion of an award to the player the results of the monitoring of the attributes are reset 114.

Figure 2:
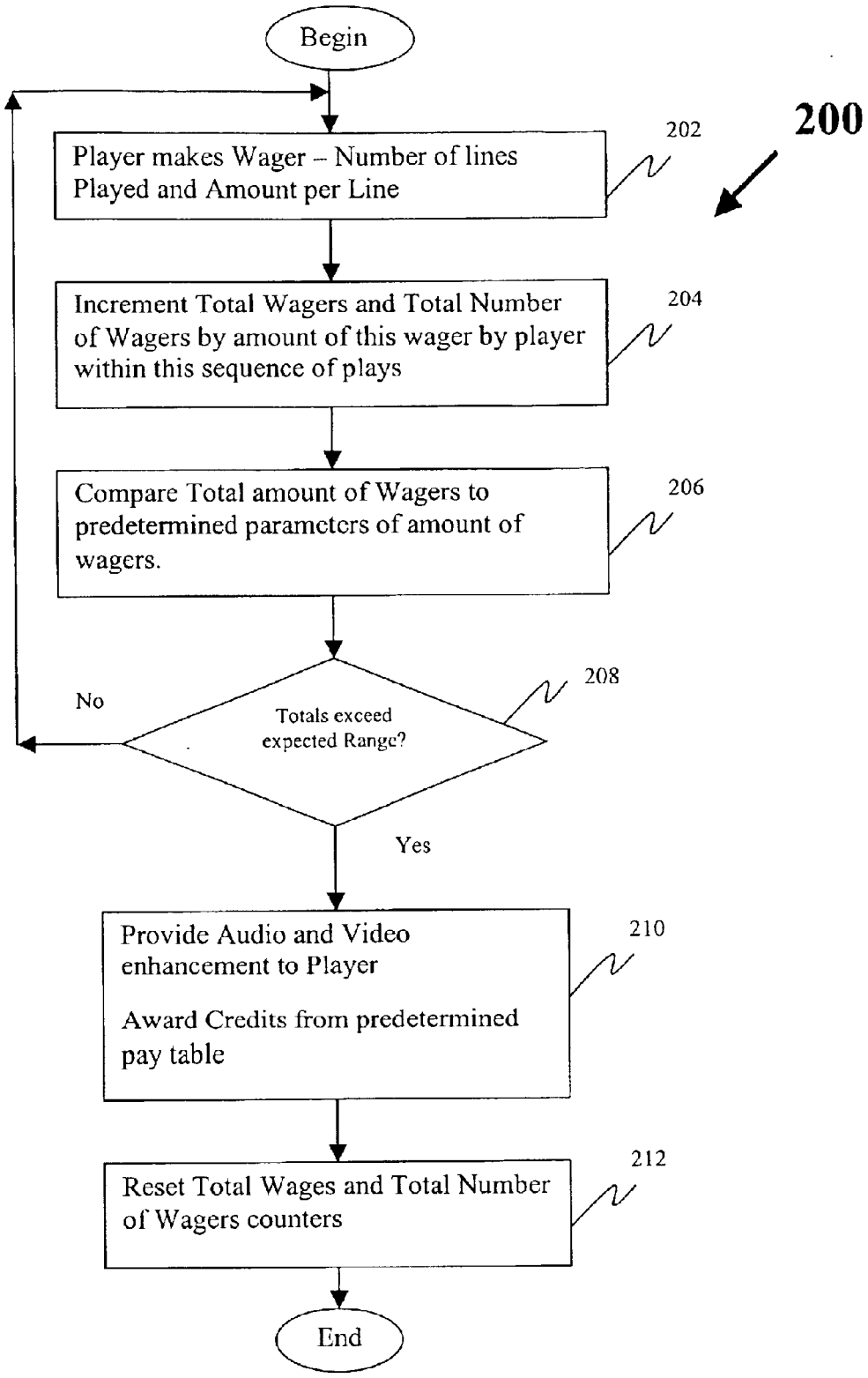
FIG. 2 is a block diagram of a flow chart with the steps of another embodiment of the method for an enhanced interactive casino game.

Another method in FIG. 2 for providing enhanced interactive playing of a casino game by a player has steps and is shown. The player is allowed to make a wager and play 202. There is the step of tracking wagering information for an attribute within a sequence of plays 204. The step of enhancing interaction for the player based upon the comparison of the wagering information within the sequence of plays to predetermined parameters is followed 210. The player is awarded due to the step of tracking wagering information within the sequence of plays 206. The step of tracking wagering information may preferably include the step of collecting the number and amount of wagers eligible for the attribute 204. The step of enhancing interaction is performed with audio or visually 210. The step of awarding the player is a consequence of the step of enhanced interaction 210. A monetary award may also be given. The step of awarding the player is a consequence of the step of enhanced interaction by the step of analyzing mathematically the step of tracking wagering information 208. Upon completion of an award to the player the results of the tracking of wagering information is reset 212.

Figure 3:
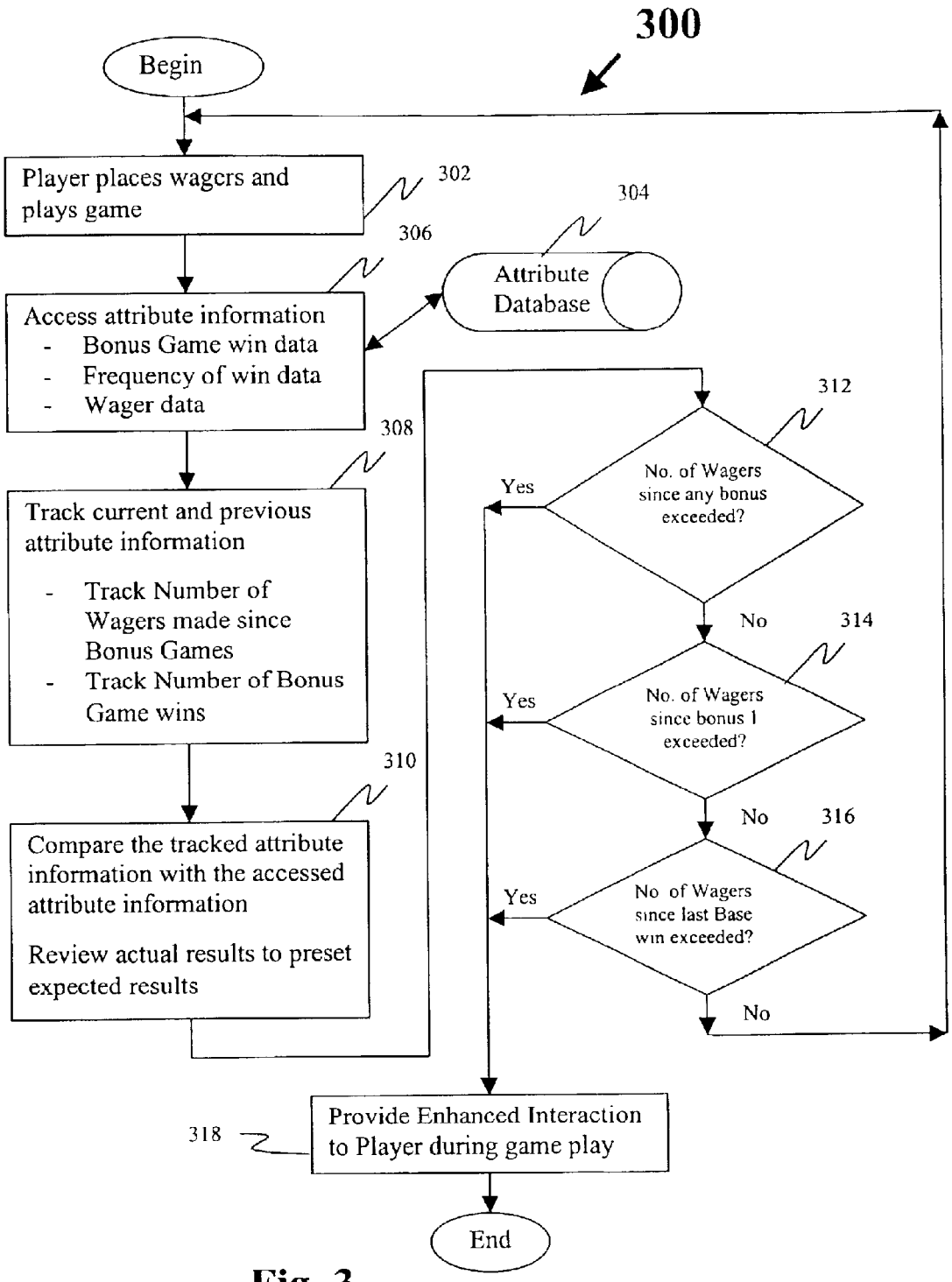
FIG. 3 is a block diagram of a flow chart with the steps of a still further embodiment of the method for an enhanced interactive casino game.

A method for enhanced interactive playing of a casino game with an attribute by a player is shown in FIG. 3 starting with allowing the player to wager and play the casino game 302. Attribute information concerning the theoretical frequencies of each bonus game, any bonus game, and specific or all base game pay combinations is stored in a separate database 304. Information related to the attribute of interest are accessed from the stored attribute information 306. Actual attribute information based on the history and chronology of previous play is tracked 308. The tracked attribute information is compared with the accessed information from the stored attribute information 310. The step of comparing the attribute information and the tracking information is mathematically performed 310. The comparisons, by way of example, may be for the number of wagers made (or the number of paylines played) since the last time the play saw any bonus 312, the last time the player saw a particular bonus 314, or the last time the player saw a particular base game win 316. The step of enhancing interaction for the player 318 is based upon results of the comparing. In step 318, an award may also be given if desired.

Figure 4:
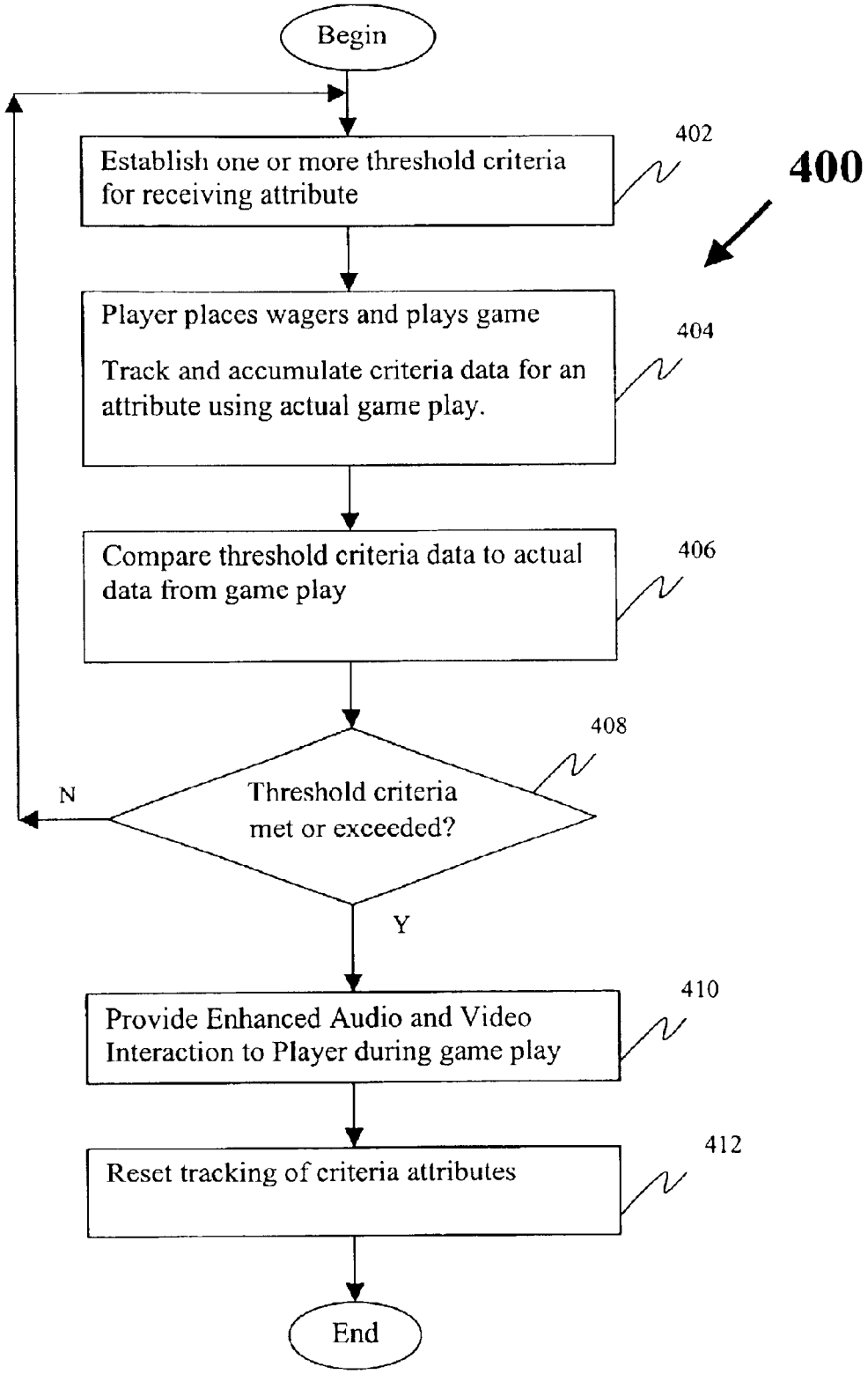
FIG. 4 is a block diagram of a flow chart with the steps of one more embodiment of the method for an enhanced interactive casino game.

A method for enhanced interactive playing of a casino game with an attribute by a player is shown in FIG. 4. Establishing one or more threshold criteria for the attribute is denoted 402. The player is allowed to wager and play the casino game 404. The actual casino game data related to the attribute is compared to the thresholds 406. Enhanced interaction 410 is provided to the player if the tracked data fulfills at least one-threshold criteria 408 during enhanced interactive playing of the casino game. Also in 410, the player may be given a monetary award, in a preferred embodiment. Upon completion of an award to the player the results of the tracking of the attributes is reset 412.

Too, the instant invention is not limited to a bonus game as an attribute. The attribute under consideration may be, for example, a win of 100× the wager on the base game, the number of successive wins and/or losses on the base game, a win of a prescribed number of credits (e.g., 500 credits) on the base game, etc. All of these attributes are within the scope of this invention, and all may include the use of thresholds to further enhance the player's gaming experience.

While the examples illustrating the enhanced interactive casino game different options for interaction are explained throughout the preceding disclosure, skilled artisans will appreciate that many variations of the execution will be possible. The specific examples should not be considered limiting and the particular apparatus and/or methods disclosed and shown in the figures are merely for illustration of different forms.

What is claimed:

1. A method for providing enhanced interactive playing of a casino game by a player comprising the steps of:

receiving from the player in the casino game sequential wagers to play the casino game;

tracking at least received wagering information within a sequence of plays between the occurrences of an attribute in the casino game, enhancing interaction for the player based upon the step of tracking wagering information within the sequence of plays, wherein the step of enhancing interaction is performed with an audio message to the player.

2. The method of claim 1 further comprising the step of awarding the player based upon the step of tracking wagering information within the sequence of plays.

3. The method of claim 1 wherein the step of tracking wagering information includes the step of collecting a number and amount of wagers eligible for the attribute.

4. The method of claim 2 wherein the step of awarding the player is a consequence of the step of enhancing interaction.

5. The method of claim 2 wherein the step of awarding the player is a consequence of the step of enhancing interaction with a further step of analyzing mathematically the step of tracking wagering information.

6. A method for providing enhanced interactive playing of a casino game by a player comprising the steps of:

receiving from the player in the casino game sequential wagers to play the casino game;

tracking at least received wagering information within a sequence of plays between the occurrences of an attribute in the casino game, enhancing interaction for the player based upon the step of tracking wagering information within the sequence of plays, wherein the step of enhancing interaction is performed with a visual message to the player.

7. A method for enhanced interactive playing of a casino game with an attribute by a player comprising the steps of:

allowing the player to sequentially wager and play the casino game;

accessing information related to the attribute from stored attribute information in a database of the casino game;

trackinq attribute information concerning history and chronology of play between occurrences of the attribute;

wherein the steps of accessing information and tracking attribute information include the step of analyzing frequency of a bonus game;

comparing the tracking attribute information with the accessed information related to the attribute from the stored attribute information when the attribute next occurs;

enhancing interaction for the player based upon results of the comparing.

8. The method of claim 7 further comprising the step of awarding the player based upon the results of comparing.

9. The method of claim 7 with the step of comparing the tracking attribute information with the accessed information is mathematically performed.

10. The method of claim 7 wherein the step of tracking attribute information includes the step of analyzing sequential wagering by the player.

11. The method of claim 10 wherein the step of analyzing sequential wagering includes the step of reviewing the expected number of wagers made between the occurrences of preset results of the comparing step.

12. The method of claim 7 wherein the step of tracking attribute information includes the step of reviewing an actual number of sequential wagers made by the player between occurrences of preset results of the comparing step.

13. The method of claim 12 wherein the step of comparing includes the step of calculating the actual number of sequential wagers made between occurrences of preset results of the comparing step.

14. The method of claim 7 wherein the steps of accessing information and tracking attribute information include the step of analyzing the frequency of a prescribed win.

15. A method of sequentially playing by a player a casino game having a randomly occurring bonus game comprising:

incrementing a total wager amount by the amount of the wager for each casino game played after a bonus game occurs;

incrementing a total lines played number by the lines played for each said casino game played after the bonus game occurs;

comparing the total wager amount and total lines played number to a predetermined range when a next bonus game occurs;

if the total wager amount and the total lines played number exceed a lower limit of the range, then delivering a first message to the player acknowledging an early return to bonus game play;

if the total wager amount and the total lines played number exceed a higher limit of the range, then delivering a second message to the player acknowledging a late return to the bonus game play;

resetting the total wager amount and total lines played number after play of the next bonus game.

16. The method of claim 15 further comprising:

crediting the player an early award with delivery of the first message.

17. The method of claim 16 wherein the next bonus game occurs back-to-back to when the first bonus game occurs and wherein the early award is substantial.

18. The method of claim 15 further comprising:

crediting the player a late award with delivery of the second message.

19. A method of sequentially playing by a player a casino slot game having a randomly occurring bonus game comprising:

incrementing a total wager amount by the amount of the wager from each sequential casino slot game played by the player after a bonus game occurs;

incrementing a total lines played number by the lines played for each said casino slot game played after the bonus game occurs;

comparing at least the total wager amount to at least one threshold value when a next bonus game occurs;

when the total wager amount exceeds the at least one threshold value, then awarding the player credits from a predetermined pay table;

resetting the total wager amount after play of the next bonus game.

20. The method of claim 19 wherein the at least one threshold value is a range having a higher limit threshold value and lower limit threshold value.

21. The method of claim 19 further comprising:

when the total wager amount exceeds the at least one threshold value, then delivering a message to the player.

22. The method of sequentially playing by a player a casino game comprising:

providing an attribute in the casino game;

wherein the attribute is the occurrence of bonus game play when the casino game has a bonus game and wherein the attribute amount is at least based upon the amount of wager for each casino game played after the occurrence of the first bonus game until the occurrence of the next bonus game;

incrementing an attribute amount in the casino game based upon attribute information after an attribute occurs in the sequential play of the casino game;

comparing in the casino game the incremented attribute value to a threshold criteria when the attribute occurs next;

delivering a message from the casino game to the player acknowledging that the threshold criteria has been met;

crediting the player with an award when the threshold criteria has been met;

resetting the attribute amount in the casino game after delivering the aforesaid message.

23. The method of claim 22 wherein the attribute is a credit win value in sequential play of the casino game and the threshold criteria is a function of at least the wager on each sequential play of the casino game until the next predetermined credit win occurs.

24. The method of claim 22 wherein the attribute is successive wins by the player in sequential play of the casino game and the threshold criteria is based upon the number of successive wins.

25. The method of claim 22 wherein the attribute is successive losses by the player in sequential play of the casino game and the threshold criteria is based upon the number of successive losses.

26. The method of claim 22 wherein the attribute is winning credits in play of the casino game and the threshold is a prescribed number of winning credits.

* * * * *